United States Patent [19]

Eibe

[11] 4,054,043

[45] Oct. 18, 1977

[54] CLOSED LOOP INTEGRATED GAUGE AND CROWN CONTROL FOR ROLLING MILLS

[75] Inventor: Werner W. Eibe, McCandless Township, Allegheny County, Pa.

[73] Assignee: Blaw-Knox Foundry & Mill Machinery, Inc., Pittsburgh, Pa.

[21] Appl. No.: 746,848

[22] Filed: Dec. 2, 1976

[51] Int. Cl.[2] ..... B21B 37/08

[52] U.S. Cl. ..... 72/8; 72/21

[58] Field of Search ..... 72/6, 8, 21, 35, 245

[56] References Cited

U.S. PATENT DOCUMENTS

| | | | |
|---|---|---|---|
| 3,182,587 | 5/1965 | Woodhall | 72/200 X |
| 3,570,288 | 3/1971 | Fischer et al. | 72/8 |
| 3,714,805 | 2/1973 | Stone | 72/8 |
| 3,803,886 | 4/1974 | Sterrett et al. | 72/8 |
| 3,877,270 | 4/1975 | Marten | 72/21 |
| 3,938,360 | 2/1976 | Shida et al. | 72/8 |

*Primary Examiner*—Milton S. Mehr
*Attorney, Agent, or Firm*—Buell, Blenko & Ziesenheim

[57] ABSTRACT

In a four-high mill stand separate transducer means are provided for measuring gauge in the bite of the work rolls and for measuring the inclination of work roll axis to the horizontal. Means are provided for generating a gauge command signal proportional to the work gauge and a crown command signal proportional to the desired work roll crown. The gauge and gauge command signals are added algebraically and applied to control the roll pressure producing means in the roll stand, and the crown, crown command and the gauge signals are added algebraically and applied to control the work roll bending means so that changes in the roll bending force do not change gauge, and the gauge and flatness of the rolled product are automatically held constant. A roll crown measuring transducer for high lift mills is also disclosed.

14 Claims, 12 Drawing Figures

CLOSED LOOP INTEGRATED GAUGE AND CROWN CONTROL FOR ROLLING MILLS

In flat product mills such as those for hot plate or strip rolling, as well as for cold rolled strip, most gauge control systems have been based upon what is known as the gauge-meter system. By this method, gauge is held at a certain value by reading the rolling forces and knowing the spring constant or mill modulus of a mill stand. Since a direct, dimensional measurement of gauge could not be obtained in the roll bite, it was necessary to rely on instruments, such as x-ray gauges, mounted outside of the mill stand to monitor and correct the performance of the gauge-meter system. This naturally involves a certain delay time since the measured portion of the product has to travel from the roll bite to the gauge. With mechanical screwdowns, this delay is increased by their inertia before a gauge correction can be initiated.

In my U.S. Pat. No. 3,864,955 I disclose means for mounting linear transducers between work roll chocks so as to obtain a direct measurement of gauge in the roll bite. This apparatus, when used with fast acting means for applying roll pressure, such as hydraulic cylinders, makes possible rapid gauge correction.

The shape control of plate or strip was historically accomplished by grinding a certain "belly" or crown onto the work or backup roll bodies which compensated for the roll deflections under rolling load. Since these roll crowns could not be varied during rolling, this method only compensated exactly for a single strip width and finish pass loading. Later, variable crowning methods for work rolls and back-up rolls were developed which used hydraulic jacks for bending those rolls, thus counteracting the deflections due to the rolling force. However, prior to my invention to be described herein, it was still the operator who provided the feedback to the crowning cylinders by watching the flatness of the material as it emerged. With heavier gauges of strip and plate this flatness or shape was hard to determine visually. Flatness control systems have been devised that measure the strip flatness by passing it over special transducerized deflector rolls outside of the mill. Feedback from those rolls then corrects the roll bending inside the mill. This is still an "after-the-fact" measurement and can only be used if the strip is thin enough. When rolling plate, which is not coiled, this method cannot be applied.

One system designed to control a variable crown directly in the roll bite is described in U.S. Pat. No. 2,903,926. There the roll-crowning forces are held proportional to the rolling forces through an open loop system. In other words, the roll bending is performed automatically by following the fluctuating rolling forces. However, there is no feedback to the control system other than the operator's judgment. The actual plate shape can only be established by out-of-the-stand measurements after rolling. Furthermore, for every plate width new proportions between rolling and roll bending forces have to be determined.

Most of the above described roll bending systems have the disadvantage that they use hydraulic jacks which, with crowning changes, add or subtract from the rolling forces, creating so-called gauge interference. In order to keep these bending forces out of the gauge control loop, costly mechanical means have been proposed which isolate these forces. Reaction beams such as are disclosed in U.S. Pat. No. 3,364,715 prevent the bending cylinder forces from going into the mill housings, thus causing no additional stretch and increase in gauge. However, any required change of gauge also has its undesired effect on the strip crown, which may have been perfectly flat before the gauge change was required.

It is an object of my invention to provide closed loop feedback apparatus for maintaining a predetermined gauge in the rolls of a mill stand. It is another object to provide closed loop feedback apparatus for maintaining a predetermined crown in the rolls of a mill stand without varying the gauge. It is also an object to have a roll crown position controlled by the use of linear transducers which hold the axes of the rolls at a position not affected by the roll bending characteristic change due to changing strip width. It is yet another object to provide a transducer suitable for the apparatus above indicated which is adapted for use in highlift mills. Other objects of my invention will appear in the course of the description thereof which follows.

My invention will be more readily understood by reference to the attached Figures, of which:

My invention comprises apparatus for mounting transducers between the work roll necks in a four-high mill so as to measure gauge directly, a transducer between the ends of the work roll necks to measure the crown of the work rolls or the inclination of their axes to the horizontal, and apparatus utilizing the signals from those transducers to control pressure-producing means and crown-producing means in the mill so as to maintain constant both gauge and flatness in the rolled product of the mill stand. My invention also comprises a roll crown measuring transducer for high lift mills which is not connected to the ends of the work roll necks, but is supported by a swinging arm which holds the transducer between the ends of the work roll necks so that the latter make contact therewith when they approach each other, or which swings it out of the way when those rolls are to be changed.

Figures 1, 2:
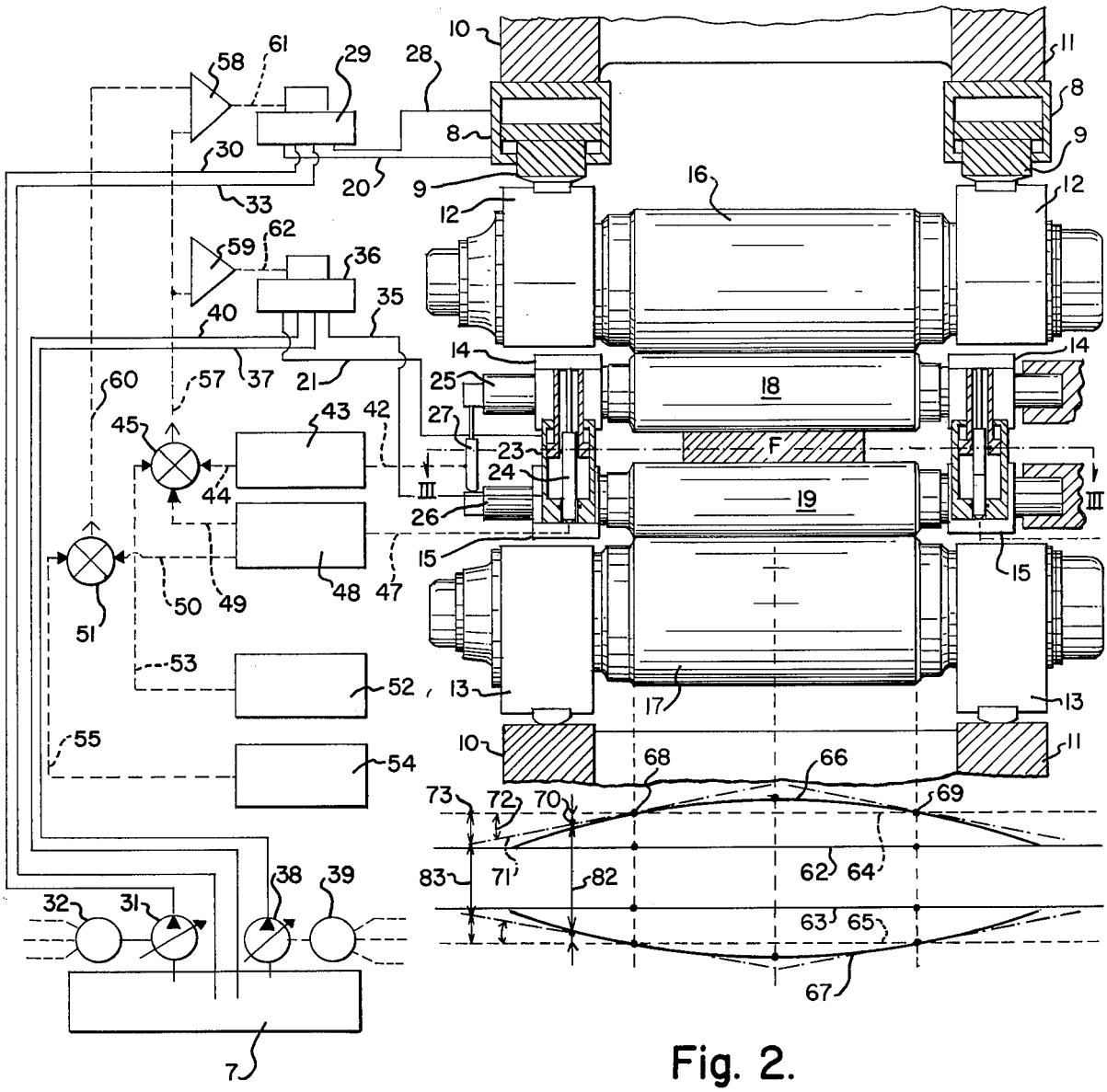
FIG. 1 is a schematic arrangement of an embodiment of my invention in a four-high mill stand.
FIG. 2 is a diagram of the deflection of the axes of the work rolls in the mill stand of FIG. 1.

A first embodiment of my invention presently preferred by me is illustrated diagrammatically in FIG. 1. A mill stand suitable for my invention comprises an operator's side housing 10 and a drive side housing 11 tied together at top and bottom in conventional fashion. Each housing is formed with a conventional window, within which windows are positioned upper backup roll chocks 12, lower backup roll chocks 13, and, between them, upper work roll chocks 14 and lower work roll chocks 15. Upper backup roll 16 is journalled in chocks 12, lower backup roll 17 is journalled in chocks 13, upper work roll 18 is journalled in chocks 14 and lower work roll 19 is journalled in chocks 15. A hydraulic cylinder 8 with pistor 9 is positioned between the top of housing 10 and chock 12 and a like cylinder and piston is positioned in the same way in housing 11. Chocks 13 rest on the bottom of housings 10 and 11.

Figure 3:
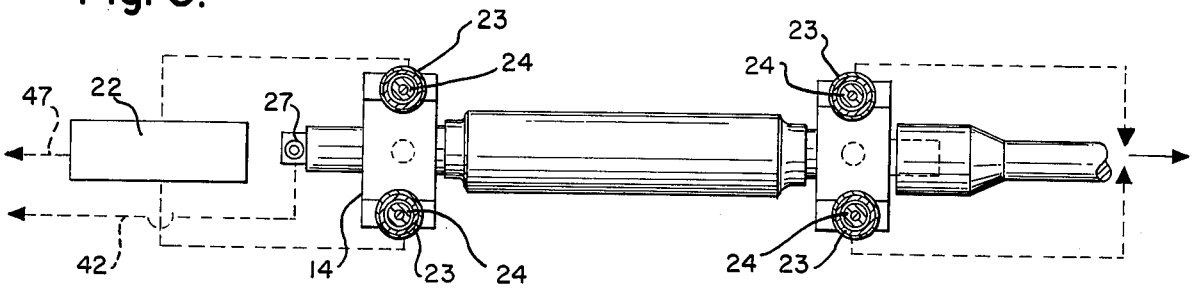
FIG. 3 is a horizontal section through the mill stand of FIG. 1 taken on the plane III—III.

Between chocks 14 and 15 in housing 10 is positioned a pair of hydraulic roll-bending cylinders 23, one on each side of the roll neck, as is best seen in FIG. 3. A like pair is positioned in the same location in housing 11. Centrally located within each cylinder 23, is a transducer 24. Work rolls 18 and 19 are provided with elongated necks 25 and 26 respectively which extend through the window in housing 10. Between the outer ends of necks 25 and 26 is fixed a transducer 27. Transducers 24 and 27 are preferably of the form disclosed in my U.S. Pat. No. 3,864,955 previously mentioned.

Hydraulic fluid is supplied to pressure cylinders 8 through conduits 20 and 28 from servo valve 29. The latter is furnished hydraulic fluid through conduit 30 from pump 31 which is driven by motor 32. Pump 31 pumps hydraulic fluid from tank 7 and servo valve 29 discharges into that tank through conduit 33. In like manner, roll bending cylinders 23 are supplied with hydraulic fluid through conduits 21 and 35 from servo valve 36. That valve is furnished hydraulic fluid through conduit 37 from pump 38 which is driven by motor 39. Pump 38 pumps hydraulic fluid from tank 7 and servo valve 36 discharges into that tank through conduit 40.

The electrical output of transducer 27 is connected by conductor 42 to the input of crown signal conditioner 43. The output of conditioner 43 is connected by conductor 44 to summing junction 45. The electrical output of transducers 24 is averaged in averager 22 as is shown in FIG. 3 and is then connected to gauge signal conditioner 48 by conductor 47. The output of conditioner 48 is connected to summing junction 45 by conductor 49 and to summing junction 51 by conductor 50. Conditioners 43 and 48 are conventional and may include amplifiers, signal shaping elements and the like. Crown input command 52 is connected by conductor 53 to summing junction 45. Gauge input command 54 is connected by conductor 55 to summing junction 51. Those commands furnish signals which can be adjusted to correspond to the desired crown and gauge respectively and incorporate read-outs of those values. Summing junction 45 is connected by conductor 57 to the inputs of gauge servo amplifier 58 and crown servo amplifier 59. Summing junction 51 is connected by conductor 60 to the input of gauge servo amplifier 58. The output of that amplifier is connected by conductor 61 to servo valve 29 and the output of crown servo amplifier 59 is connected by conductor 62 to servo valve 36.

I have specifically described above the connections for my apparatus as applied to housing 10 on the operator's side of the mill stand. That apparatus is duplicated on the drive side of the mill stand, with the exception of transducer 27, and is connected to control apparatus in the same way as has been described for the operator's side of the mill stand. A transducer identical to 27 would have to be located between the drive spindles for the work rolls 18 and 19, which presents difficulties. I find that transducer 27 is adequate to furnish signals to both sides as long as the work is reasonably well centered in the rolls of the mill stand.

In the operation of my apparatus crown signal conditioner 43 and gauge signal conditioner 48 are adjusted so that their outputs are of opposite polarity. The signals generated by transducers 27 and 24 and appearing on conductors 44 and 49 respectively are brought to summing junction 45 and are there compared with the signal on conductor 53 from crown input command 52. The bending of the workroll necks 25 and 26 toward each other about the fulcrum at the roll midpoint, shown as F in FIG. 1, caused by the application of rolling pressure on those roll necks is counterbalanced by bending the work rolls in the opposite direction about the same fulcrum by bending cylinders 23. The amount of this bending is initially set by adjusting the crown input command 52. Should the material entering the mill display changes in hardness, flatness or gauge, an error signal will appear on conductor 57. That error signal is applied both to crown servo amplifier 59 and gauge servo amplifier 58, so that working pressure cylinders 8 increase or decrease their force by an incremental amount and bending cylinders 23 increase or decrease their force by the same incremental amount but in the opposite direction. Thus, the sum of the vertically acting forces on housings 10 and 11 remains unchanged, and there is no change in the gauge of the work being rolled. However, the bending moment exerted on work rolls 18 and 19 is changed by the product of the change in force of bending cylinders 24 multiplied by their lever arm, the distance between fulcrum F and cylinders 23 or any distance along the face of the backup roll towards the edges indicated by points 68 and 69. Therefore, the flatness of the work is preserved.

The gauge desired is initially set by adjustment of gauge input command 54. The signal from transducer 24 through gauge signal conditioner 48 is summed with the reference signal from gauge input command 54 in summing junction 51 and the error signal resulting is applied to gauge servo amplifier 58. In response thereto, servo valve 29 adjusts the fluid pressure in pressure cylinder 8 so as to change the roll gap and thus the signal generated by transducer 24 in the direction to bring the error signal to zero.

The control effected by my apparatus above described is graphically shown in FIG. 2, which is a diagram of work roll deflection across the mill stand. Parallel lines 62 and 63 are the axes of work rolls 18 and 19 respectively when the mill stand is rolling flat, on-gauge product. If the material entering the mill stand should increase in thickness or hardness, lines 62 and 63 would tend to be displaced from each other to parallel lines 64 and 65 respectively because of mill stand stretching. The increased force on the work rolls resulting therefrom would, however, cause those rolls to deflect or bend about central fulcrum F so that their axes would assume the contours of curved lines 66 and 67. Lines 66 and 64 would coincide at points 68 and 69 which lie in the plane of the two ends of the roll bodies 18 and 19 and lines 67 and 65 would correspond at a pair of points directly below points 68 and 69 in the Figure. It is evident that for both original roll axes 62 and 63 and for displaced roll axes 64 and 65 the deflection of transducer 24, lying in the plane parallel to the ends of rolls 18 and 19 through point 70, and that of transducer 27, lying in a similar plane through point 73, are equal. That is not true for the curved roll axes 66 and 67. Tangent 71 to line 66 at point 68 is inclined at an angle 72 to line 64. Transducer 24 has now increased according to distance 82 whereas transducer 27 only increased to distance 83. The difference between the two transducer readings thus is an indication of the slope or angle 72 of the bent rolls. My apparatus acts to reduce this angle 72 to zero and to maintain it at that value.

Figure 4:
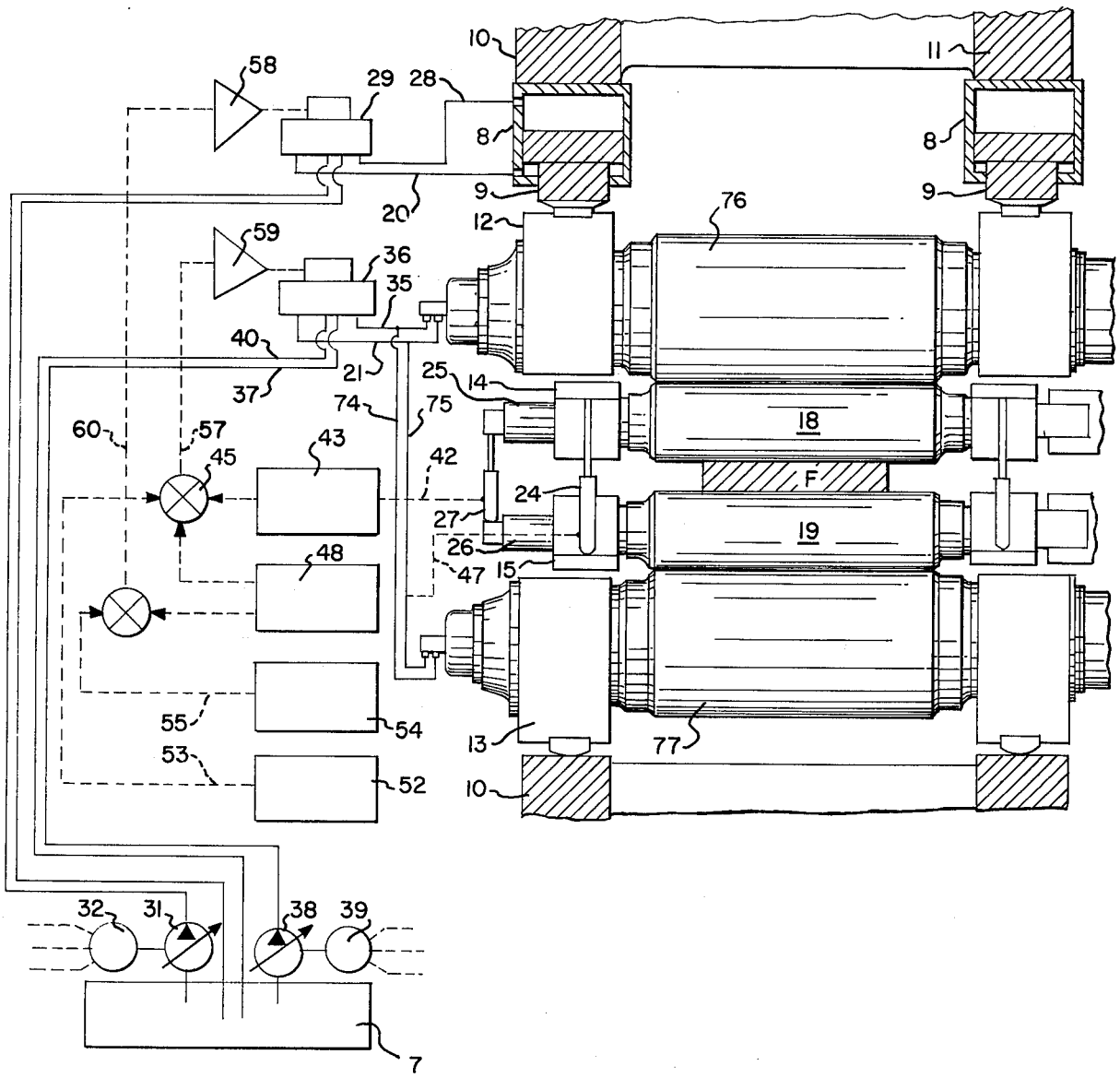
FIG. 4 is a schematic arrangement of a second embodiment of my invention.

Another embodiment of my invention presently preferred by me is shown diagrammatically in FIG. 4. That apparatus differs from the apparatus previously described in that no work roll bending cylinders or jacks are employed. Roll bending is accomplished in the backup rolls by the use of adjustable crown rolls exemplified by U.S. Pat. No. 3,457,617. Briefly, the rolls comprise a sleeve fitted over a mandrel but with a small gap between sleeve and mandrel into which hydraulic fluid is pumped to increase their separation at their center, thus producing a crown. The crowned backup rolls then bend the work rolls to provide them with a corresponding crown. Those elements of the apparatus which are identical with those described in connection with the embodiment of FIG. 1 are identified in FIG. 4 by the same reference characters and only the differences between the two embodiments will be described here.

Adjustable crown backup rolls 76 and 77 take the place of conventional backup rolls 16 and 17. Hydraulic fluid from servo valve 36 is conducted by conduits 21, 35, 74 and 75 only to rolls 76 and 77 by rotary connections in the ends of those rolls, preferably on the drive side of the mill. In the electrical circuit conductor 57 connects summing junction 45 with crown servo amplifier 59, but not with gauge servo amplifier 58.

In the operation of this embodiment of my apparatus changes in the hardness, flatness or gauge of materials entering the mill stand produce an error signal on conductor 57 as before. That signal is applied only to crown servo amplifier 59 and servo valve 36 actuated thereby, supplied hydraulic fluid only to backup rolls 76 and 77, altering their crown as has been mentioned above. This procedure does not affect the elongation of mill housings 10 and 11 so that no compensating action from pressure cylinders 8 is required. Those cylinders are operated only in response to gauge signals from transducer 24. The operation of this embodiment of my apparatus is somewhat simpler than the operation of the embodiment of FIG. 1.

Figure 5:
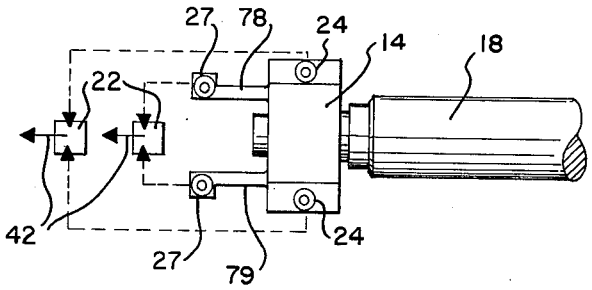
FIG. 5 is a detail plan of work roll chocks having a modified transducer mounting.
Figure 6:
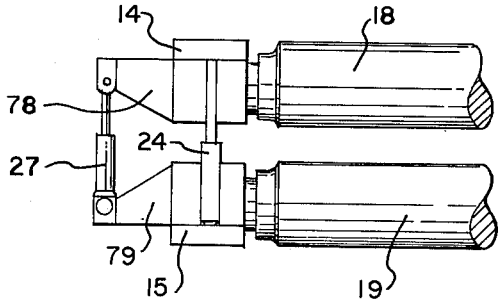
FIG. 6 is an elevation of the detail of FIG. 5.

It is not essential that transducer 27 be mounted between extended work roll ends 25 and 26 as it is shown in FIGS. 1 and 4. The transducer can be mounted in lateral extensions of the work roll chocks. Such a structure is shown in FIGS. 5 and 6. Work roll chocks 14 and 15 are each provided with a pair of laterally extending arms 78 and 79 respectively, one on each side of the work roll axis. A pair of transducers 27 is mounted between the outer ends of corresponding upper arms 78 and lower arms 79. The outputs of the transducers are connected to an averager 22 which, as before, adds the signal voltages and divides them by two. Conductor 42 is connected to the output of averager 22. The arms 78 and 79 tilt with the bending of work rolls 18 and 19 in the same way as the elongated work roll ends 25 and 26 of the embodiments of FIGS. 1 and 4.

Figure 7:
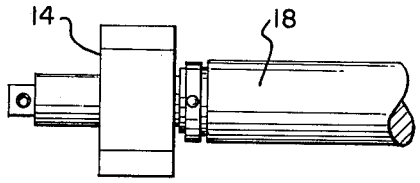
FIG. 7 is a detail plan of work rolls with transducers mounted directly thereon.
Figure 8:
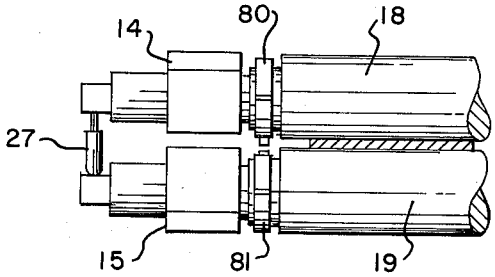
FIG. 8 is an elevation of the detail of FIG. 7.

In low-lift mill stands such as mill stands for hot or cold strip mills, transducers other than those previously described herein can be used. FIGS. 7 and 8 illustrate a work roll arrangement employing commercially available eddy current transducers 80 and 81 mounted on the necks of work rolls 18 and 19 respectively. The output signal of such transducers changes with changes in the gap between them. Since both transducers are on the roll center lines no averager is needed.

High lift mills such as reversing mills for rolling plate are sometimes required to open a considerable distance to accommodate thick slabs, but do not require gauge and shape control until the work has been reduced to a thickness which may be a small fraction of their initial roll opening. A swing-out crown transducer of relatively short stroke, suitable for such mills, is shown in FIGS. 9–12.

The transducer assembly 84 to be describe in detail hereinafter is mounted on horizontal arm 85 which swings about a vertical pivot 86 carried by lugs 87 affixed to one side of a mill housing 10. Assembly 84 is positioned so that it makes contact with but is not connected to the elongated roll necks 25 and 26 of work rolls 18 and 19. A crank arm 88 projects outwardly from arm 85 near pivot 86 and is pivotally connected at its outer end to the free end of a piston rod 89 of hydraulic cylinder 90. The other end of cylinder 90 is pivotally mounted in a bracket 91 on mill stand 10. By operating cylinder 90 the transducer assembly 84 is swung into position between the ends of the mill stand work rolls or out and away from the stand to permit roll changing.

Figure 11:
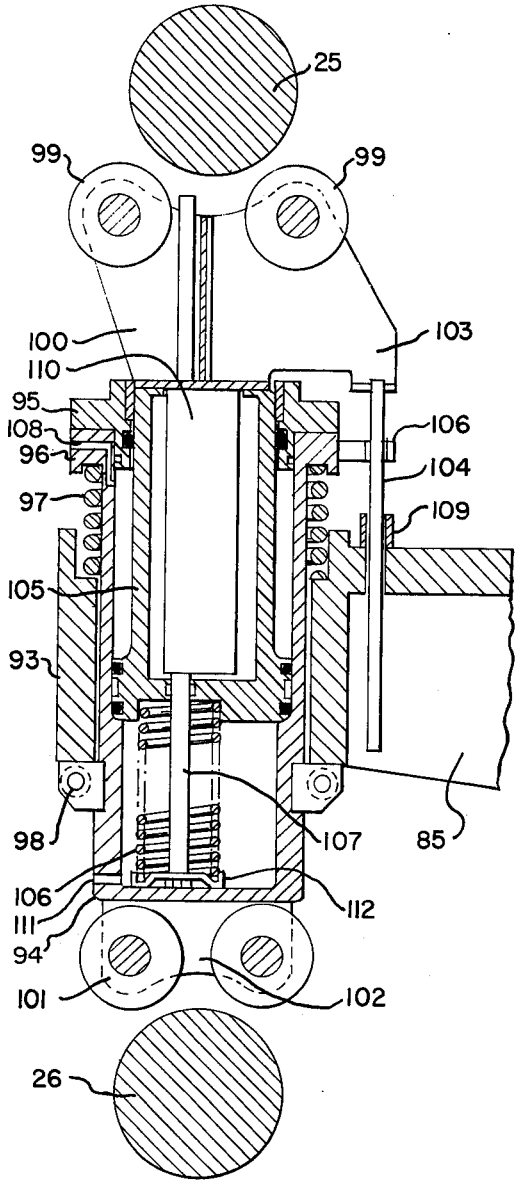
FIG. 11 is a vertical cross section through the swing-out transducer of FIG. 9 in its fully retracted position.

The structure of transducer assembly 84 in its fully retracted position is shown in FIG. 11. This is the position for work roll changing permitting the transducer assembly to be swung out free of the rolls. Swing arm 85 is affixed to an upright cylindrical housing 93 open at the upper and lower ends. Slidably positioned within housing 93 is an upright cylinder casing 94 closed at the bottom, having a bottom inlet 111 for air under pressure and carrying at the top a removable seal ring 95. An overhanging rim 96 encircles the top of casing 94 just below seal ring 95 having another air inlet 108, and between rim 96 and an internal shoulder around the top of housing 93 is positioned a compression coil spring 97 which urges casing 94 upwardly within housing 93. An annular stop 98 surrounds casing 94 below housing 93 to limit its upward movement against housing 93. Coil spring 97 urges the cylinder casing together with rollers 101 away from bottom roll 26 for purpose of roll changing.

Slidably mounted within casing 94 so as to move upwardly through seal ring 95 is closed cylinder transducer case 105 which acts as a piston urged upwardly by air pressure and also by compression spring 106. That spring is positioned below transducer case 105 and bears against the bottom of casing 94 for another purpose to be described. Affixed to the upper end of transducer case 105 is an upstanding bracket 100 carrying a pair of rollers 99 spaced apart crosswise of roll neck 25. Rollers 99 are spaced so as to make two-point contact with roll neck 25 when they are raised against it by air pressure. A like pair of rollers 101 is mounted on downwardly extending bracket 102 affixed to the bottom of casing 94. A laterally extending arm 103 of bracket 100 carries a downwardly extending rod 104 which passes through a bushing 109 set in arm 85 and through a hole in an ear 106 extending laterally from rim 96. This arrangement prevents cylindrical casing 94 from rotating within housing 93 but permits axial movement therebetween.

A vertical scale rod 107 set in casing 94 extends through holes in the top and bottom of transducer case 105 so as to permit axial movement between casing 94 and transducer case 105. It also provides a fixed point for transducer body 110 which is positioned within transducer case 105 fastened to its top plate. Spring 106 at its lower end bears against cup washer 112 which is fastened to the lower end of rod 107, thus holding that rod firmly against the bottom of casing 94 without clearance.

Figure 9:
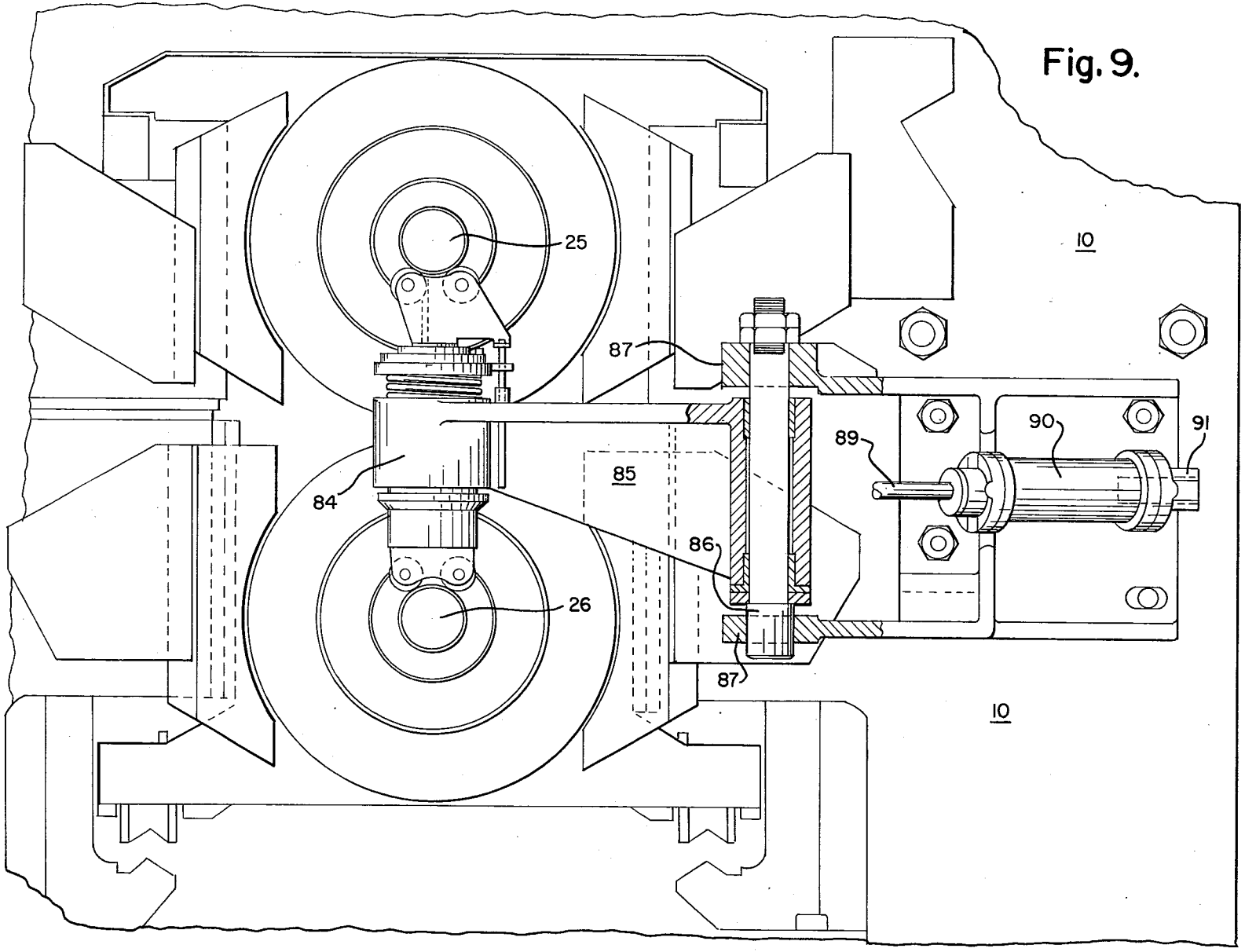
FIG. 9 is a detail end elevation of a portion of a mill stand equipped with a swing-out transducer of my invention.
Figure 10:
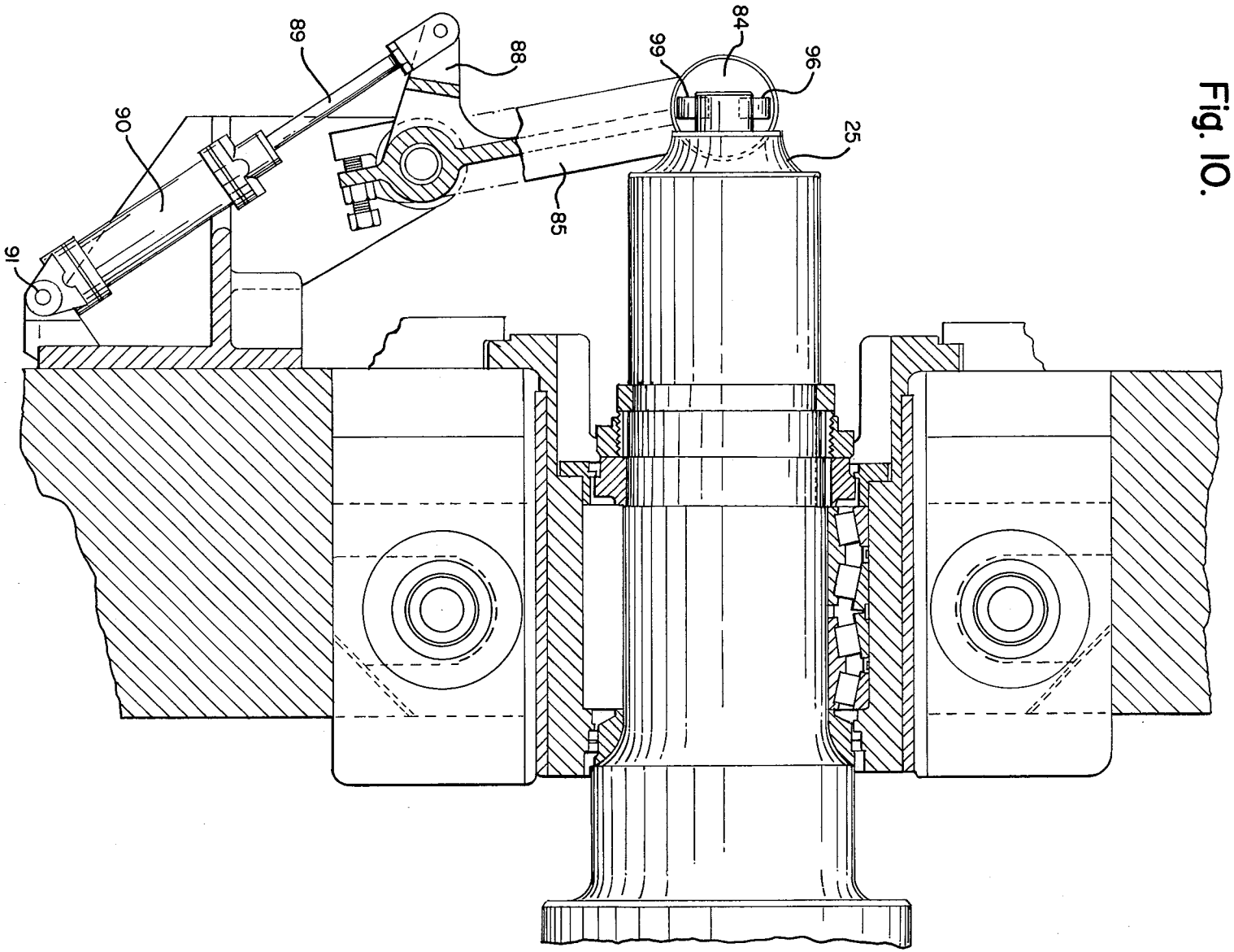
FIG. 10 is a plan of the detail of FIG. 9.
Figure 12:
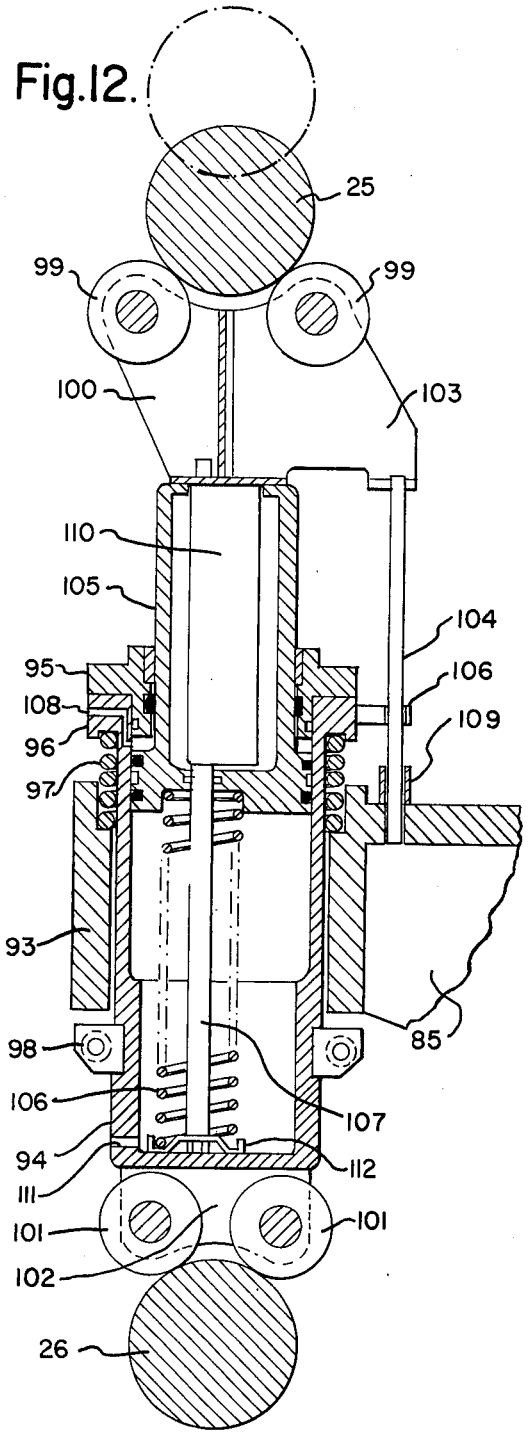
FIG. 12 is a vertical cross section through the swing-out transducer of FIG. 9 in its fully extended position.

It is evident from FIG. 11 and the foregoing description that casing 94 and everything within it and attached to it can move vertically in housing 93. Casing 94 and housing 93 are held apart by compression spring 97, and casing 94 can be depressed against the force exerted by spring 97 until the latter is fully compressed. When the transducer assembly 84 is in contact with roll necks 25 and 26, as is shown in FIG. 9 and FIG. 12, it adjusts itself to any vertical movement of those necks in unison without indicating any change in their distance apart. The air pressure in case 94 spreads the rolls 99 and 101 apart against the roll necks 25 and 26, or when applied in opposite direction withdraws them from contact with the rolls. The function of spring 97 is to allow the unit 84 to adapt itself to slightly varying passline and to raise the unit off bottom roll for roll change.

The apparatus in its fully extended measuring range position is shown in FIG. 12. Roll neck 25 is shown in contact with rollers 99 and roll neck 26 is shown in contact with rollers 101. The roll indicated in phantom lines shows the mill opened beyond the transducer range. This is the position assumed when the mill, after being opened up to receive a slab, has reduced the slab to a thickness within the range of transducer assembly 84. As roll necks 25 and 26 move toward each other, they cause transducer case 105 to move downwardly within casing 94 against spring 106 and bleeding air pressure. The transducer 110 converts that change in spacing to a change in voltage in the usual manner. Another advantage of the compressed air inside the transducer case is that it keeps the contamination of the unclean mill atmosphere away from the sensitive transducer elements.

It is evident that my invention is not limited to four-high mill stands, but is applicable to two-high or multi-high roll stands which have roll bending means. The crown signal transducer need not be positioned within the roll bending cylinder, but can be located near by. In wide mills, such as hot plate mills, the roll deflection becomes large and it may be desirable to equip such mills both with work roll bending means and with adjustable crown backup rolls together with the control means for both described herein.

In the foregoing specification I have described presently preferred embodiments of my invention; however, it will be understood that my invention can be otherwise embodied within the scope of the following claims.

I claim:

1. Apparatus for integral gauge and work roll crown control in a rolling mill stand provided with pressure means to vary the gauge of the metal in the mill stand and means to vary the crown of the work rolls, comprising first transducer means positioned to measure the separation between work rolls at chocks thereof and produce a gauge signal therefrom, second transducer means positioned to measure the separation between said work rolls outboard of said chocks and produce a signal therefrom, said signals being utilized to produce a crown signal, means to control the crown varying means in accordance with the algebraic sum of the gauge signal and the crown signal, and means to control the pressure means in correspondence with the gauge signal.

2. Apparatus of claim 1 including means for generating a gauge command signal proportional to the desired gauge and for combining it algebraically with the gauge signal and means for generating a crown command signal proportional to the desired work roll crown and for combining it algebraically with the crown signal.

3. Apparatus of claim 1 in which the means to vary the crown of the work rolls comprise work roll bending cylinders and including interconnection between the means to control the crown varying means and the means to control the pressure means so as to cancel the effect on gauge of changes in the vertical component of the work roll bending forces.

4. Apparatus of claim 1 in which the second transducer is positioned between the ends of the work roll necks.

5. Apparatus of claim 1 in which the second transducer is positioned between extensions of the work roll chocks.

6. Apparatus of claim 1 in which said crown control means means comprise hydraulic cylinders positioned between the work roll chocks and the first transducer means are positioned within said hydraulic cylinders.

7. Apparatus of claim 1 in which said crown control means means comprise a variable crown backup roll.

8. Apparatus of claim 1 in which at least one transducer has a range of movement less than the maximum opening between the work rolls and is positioned between the work rolls but not attached thereto so that the latter make contact with the transducer so as to move it when the opening between them is reduced to fall within the transducer range.

9. Apparatus of claim 8 in which the transducer is mounted on the mill stand in an arm which is swung to move it away from the rolls when the latter are changed.

10. The method of controlling rolling pressure and roll bending pressure in a rolling mill stand so as to provide independent adjustment of work gauge and flatness, comprising continuously measuring the separation between work rolls, converting that measurement to a gauge signal, continuously determining the inclination of a work roll axis to the horizontal, converting that determination to a crown signal opposite in direction to the gauge signal, applying bending pressure to the work roll necks corresponding to the algebraic sum of the gauge and the crown signals, and applying rolling pressure to the work rolls corresponding to the gauge signal and to the algebraic sum of the gauge and the crown signals.

11. The method of claim 10 in which determining the inclination of a work roll axis to the horizontal is obtained from measuring the separation between the work roll ends.

12. The method of claim 10 including the steps of generating a gauge command signal proportional to the desired gauge, generating a crown command signal proportional to the desired inclination of the work roll axis to the horizontal corresponding to the work roll pressure for the desired gauge, adding the gauge command signal algebraically to the gauge signal and adding the crown command signal algebraically to the sum of the gauge and crown signals.

13. The method of controlling rolling pressure and roll bending pressure in a four-high mill stand provided with variable crown backup rolls comprising continuously measuring the separation between the work rolls, converting that measurement to a gauge signal, continuously determining the inclination of a work roll axis to the horizontal, converting that determination to a crown signal opposite in direction to the gauge signal, applying crowning pressure to the variable crown backup roll corresponding to the algebraic sum of the gauge signal and the crown signal and applying rolling pressure to the work rolls corresponding to the gauge signal.

14. The method of claim 13 including the steps of generating a gauge command signal proportional to the desired gauge, generating a crown command signal proportional to the desired inclination of the work roll axis to the horizontal corresponding to the work roll pressure for the desired gauge, adding the gauge command signal algebraically to the gauge signal and adding the crown command signal algebraically to the sum of the gauge and crown signals.

* * * * *